US008444031B2

(12) United States Patent
Bonnet et al.

(10) Patent No.: US 8,444,031 B2
(45) Date of Patent: May 21, 2013

(54) PROP-SUPPORTING HARNESS FOR A STAGE PERFORMER

(75) Inventors: Guy Bonnet, Cornebarrieu (FR); Jean-Jacques Clerico, Neuilly sur Seine (FR)

(73) Assignee: Bal du Moulin Rouge, Paris (FR)

( * ) Notice: Subject to any disclaimer, the term of this patent is extended or adjusted under 35 U.S.C. 154(b) by 171 days.

(21) Appl. No.: 12/859,737

(22) Filed: Aug. 19, 2010

(65) Prior Publication Data

US 2011/0042431 A1 Feb. 24, 2011

(30) Foreign Application Priority Data

Aug. 21, 2009 (FR) ..... 09 55748

(51) Int. Cl.
*A45F 3/10* (2006.01)
*A63J 7/00* (2006.01)

(52) U.S. Cl.
USPC ..... 224/265; 224/907

(58) Field of Classification Search
USPC ..... 224/628, 633, 634, 265, 259, 260, 224/261, 907; 472/133; 2/305; 84/421; 128/205.22; 405/185; 446/28
See application file for complete search history.

(56) References Cited

U.S. PATENT DOCUMENTS

| | | | | |
|---|---|---|---|---|
| 504,101 | A | 8/1893 | Zbinden | |
| 3,035,747 | A * | 5/1962 | Ullrich, Jr. | 224/265 |
| 3,649,921 | A | 3/1972 | Thomas, Jr. | |
| 3,767,095 | A | 10/1973 | Jones | |
| 3,774,825 | A | 11/1973 | Schone et al. | |
| 4,013,201 | A | 3/1977 | Potter | |
| 5,573,158 | A * | 11/1996 | Penn | 224/265 |
| 5,829,874 | A * | 11/1998 | Breeding | 366/120 |
| 6,234,530 | B1 * | 5/2001 | Carter | 280/810 |
| 7,175,496 | B1 * | 2/2007 | Lund et al. | 446/28 |
| 7,621,066 | B1 * | 11/2009 | Mathison | 43/21.2 |
| 8,087,969 | B2 * | 1/2012 | Sun et al. | 446/28 |
| 2005/0098597 | A1 | 5/2005 | Cottrell et al. | |
| 2006/0144400 | A1 | 7/2006 | Grassl | |
| 2006/0186151 | A1 | 8/2006 | May | |

FOREIGN PATENT DOCUMENTS

| | | | |
|---|---|---|---|
| DE | 102004061661 | B3 | 2/2006 |
| FR | 2887126 | A1 | 12/2006 |
| GB | 189714882 | A | 0/1897 |
| GB | 870215 | A | 6/1961 |
| GB | 2275865 | A | 9/1994 |

OTHER PUBLICATIONS

English Translation Abstract for DE102004061661, which is also published as US2006/0144400.
FR Search Report mailed Mar. 23, 2010 for FR 0955748.

* cited by examiner

*Primary Examiner* — Justin Larson
(74) *Attorney, Agent, or Firm* — Gardere Wynne Sewell LLP; Andre M. Szuwalski

(57) ABSTRACT

A harness for the wearing of at least one stage prop by a stage performer includes a frame with a backrest suitable for supporting the stage prop, and elements forming shoulder supports suitable for positioning and/or maintaining the harness in place on the artist's shoulders. The backrest and the elements forming the shoulder supports are rigid. The elements forming the shoulder supports are coupled to the backrest by a pair of elastic coupling elements.

15 Claims, 6 Drawing Sheets

PROP-SUPPORTING HARNESS FOR A STAGE PERFORMER

PRIORITY CLAIM

This application claims priority from French Application for Patent No. 09 55748 filed Aug. 21, 2009, the disclosure of which is hereby incorporated by reference.

TECHNICAL FIELD

This invention relates in general to the field of stage props, and more specifically to a prop-supporting harness which allows a stage performer to wear at least one prop on his or her back. In particular, it proposes a frame for such a harness, as well as a harness incorporating said frame.

The invention has applications particularly in the area of live entertainment, such as music halls, theater, dance, cabaret, the circus, etc.

TECHNOLOGICAL BACKGROUND

A cabaret review such as the current "Féerie" of the Bal du Moulin Rouge, is composed of a troop of about 100 artists, including the 60 "Doriss Girls" recruited from around the world, and uses 1000 costumes with feathers, rhinestones, and sequins.

These artists are true world-class athletes, who must meet extremely rigorous selection criteria concerning their physical capabilities and their ability to follow choreography that stretches these capabilities to the limit.

The entertainment the show provides to the spectators essentially arises from the visual quality of the movements of the artists, and their props, on the stage. The amplitude, rhythm of execution, and synchronization of these movements are crucial to this.

The present description relates to props carried by the artists, generally on their back, by means of a harness placed and fastened in position on the shoulders. This is typically an ensemble of feathers, rhinestones, sequins, and, more recently, electric lights, which are arranged in the form of a fanned peacock tail or similar manner.

Some scenes of the show make use of very bulky and heavy props. The overall dimensions of such props, once fastened in position on the artist, can greatly exceed the height of the artist, and can reach or even extend beyond the span of the artist's outspread arms on the stage. Their weight is usually between 8 and 12 kilograms, including the possible presence of a battery to power integrated lights such as strips of light emitting diodes (LED), neon tubes, or similar.

RELATED ART

With reference to FIG. 1 of the attached drawings, the frame of a prior art harness is made with rods or metal wires, having a circular cross-section with a diameter equal to a few millimeters or so, and which are conventionally referred to as "piano wire". Such items are of carbon steel (tempered), and therefore have a high tensile strength together with a certain capacity for static forming, and a certain dynamic elasticity.

Several such items, appropriately bent, are assembled to make a part 11 intended to rest against the back of the artist, as well as parts 12 and 13 intended to maintain the harness on the shoulders of the artist, similarly to shoulder straps. More particularly, appropriately shaped elements are welded together at certain points so that the frame as a whole has a configuration of the above parts 11, 12, and 13, in accordance with its function. Spot welds of solder 14 are placed at the end of the shoulder supports 12 and 13, at the intersection of crossing pieces of piano wire, and/or at the point of contact between such pieces where they join. Perforated disks 15 are also welded to the piano wires at given points on the part 11 forming the back, for attaching the prop by means of bolts (not represented) which pass through these disks. The harness is then covered with foam, cotton wadding, carded cotton, or similar material, and finally with an ornamental fabric such as a silky cloth sewn over it.

Because of how its frame is made, the harness ensemble has a certain elasticity, particularly parts 12 and 13 which form the shoulder supports. The harness therefore is exposed to deformation stresses which are applied at almost all points on the frame.

However, at the various locations where welds were made, the steel had been heated to red heat when applying the solder, such that it has locally lost its tensile strength. It is said to be "untempered". Due to this fact, the harness frame is mechanically fragile at these locations. The piano wires can break at the welds. It is also possible that the welds themselves may not resist the mechanical stresses applied to the frame, and may give way.

Each time a piano wire breaks or a weld gives way, that portion of the frame gains some mechanical play, which can be as extreme as a sliding movement between portions of juxtaposed piano wire. In spite of the foam surrounding the frame, such sliding between portions of piano wire is often the source of injuries to the artist. This is particularly frequent in the portion of the frame which rests on the artist's shoulders, where the greatest mechanical stresses are exerted.

Under the effect of the weight of the prop, static deformation of the frame can result which inevitably translates into improper positioning of the prop relative to the body of the artist. There are two consequences of this phenomenon. First, the alignment of the prop of the artist concerned can differ from that of the props of other artists present on the stage, which is visible to the audience as a visual imperfection. Second, the incorrect positioning of the prop creates asymmetry in the forces exerted on the artist's shoulders, which the artist must offset with postures and/or movements that have very negative effects. Muscle and/or joint pain results, both during the act and afterwards. This pain is in addition to the superficial injuries due to the sliding of the piano wire elements, and affects the health of the artists. Periods of temporary incapacity can result, leading to a medical leave of absence which, in addition to the personal and social disadvantages, poses organizational problems for the show in ensuring that the performances are properly conducted.

Lastly, repairing the frame requires stripping the harness, which involves unstitching then resewing the outside fabric. To avoid having to send the frame to a metal shop for rewelding, there may be an attempt to repair the harness using wire or adhesive tape 16, but such a repair is short-lived and the harness is only usable in a degraded manner. The manual operations mentioned above involve maintenance costs, and the harness is temporarily unusable.

SUMMARY OF THE INVENTION

The invention aims to eliminate, or at least reduce, all or part of the prior art disadvantages mentioned above.

For this purpose, a first aspect of the invention proposes a frame for a harness for the wearing of at least one stage prop by a stage performer. The frame comprises a backrest suitable for supporting the stage prop, and elements forming shoulder supports suitable for positioning and/or maintaining the harness in place on the artist's shoulders. The backrest and the elements forming the shoulder supports are rigid. The elements forming the shoulder supports are coupled to the backrest by means of elastic coupling elements.

Thus the parts of the frame in contact with the artist's body, through a covering made for example of foam and decorative fabric, are rigid. They cannot be warped or bent from the swaying effects of the stage prop caused by the artist's movements. However, a certain local elasticity does remain at the connection between the backrest and the shoulder supports, and this elasticity allows to absorb such swaying to a certain extent. The harness is therefore more solid and more resistant over time, while being more comfortable and more considerate of the artists' physical health. Maintenance operations are practically eliminated, or are at least required much more infrequently.

Additionally, in some embodiments of the invention, singly or in combination:

- the backrest comprises a front plate and a rear plate, both rigid and substantially vertical and parallel to each other while being maintained rigidly apart from each other for at least a part of their facing surfaces; this increases the rigidity of the frame,
- an upper end of the front plate is bent forwards, to follow the shape of the artist's back at the neck;
- the rear plate comprises, in its upper part, a first part folded horizontally towards the front plate, and extended by a second part folded vertically upwards, which rests against the front plate and is fixed to said front plate; this arrangement obtains the desired spacing between the two front and rear plates,
- the frame comprises an angle bracket arranged between the front plate and the rear plate in a manner that keeps them spaced apart from each other; this angle bracket contributes to reinforcing the rigidity of the backrest;
- the angle bracket comprises a horizontal part fixed to the horizontal part of the rear plate, and a vertical part fixed to the rear plate, behind said horizontal part of the rear plate; arranged in this manner, the angle bracket prevents modifications to the fold angle of the rear plate under the effect of the forces exerted by the movements of the prop,
- the backrest comprises a central opening, which reduces the weight of the harness and also facilitates covering the frame with covering materials;
- the shoulder supports are in the form of a circular tube, horizontally flattened at the upper end of the tube, and vertically flattened at the lower end of the tube; the flattened ends can then press against the body of the artist with no risk of injury;
- the elastic coupling elements each comprise at least one leaf spring; easy to produce, such springs provide strong damping with little travel (low amplitudes of movement); in addition, they are essentially flat and therefore integrate well with the invention.

Another aspect of the invention concerns a harness for a stage performer, comprising a frame according to the first aspect.

BRIEF DESCRIPTION OF DRAWINGS

Other features and advantages of the invention will be apparent from reading the following description. This description purely illustrative and is to be read with reference to the attached drawings, in which.

DETAILED DESCRIPTION OF EMBODIMENTS

Figure 1:
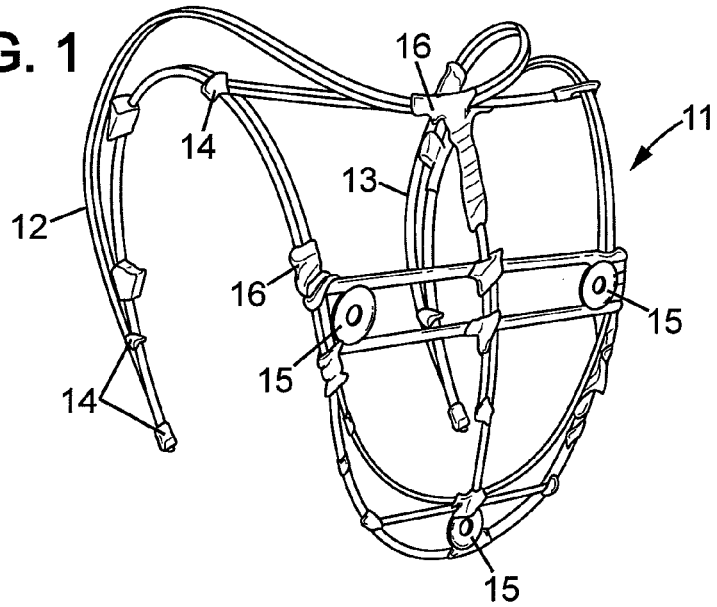
FIG. 1, already described, is a schematic representation of a harness frame of the prior art.
Figure 2:
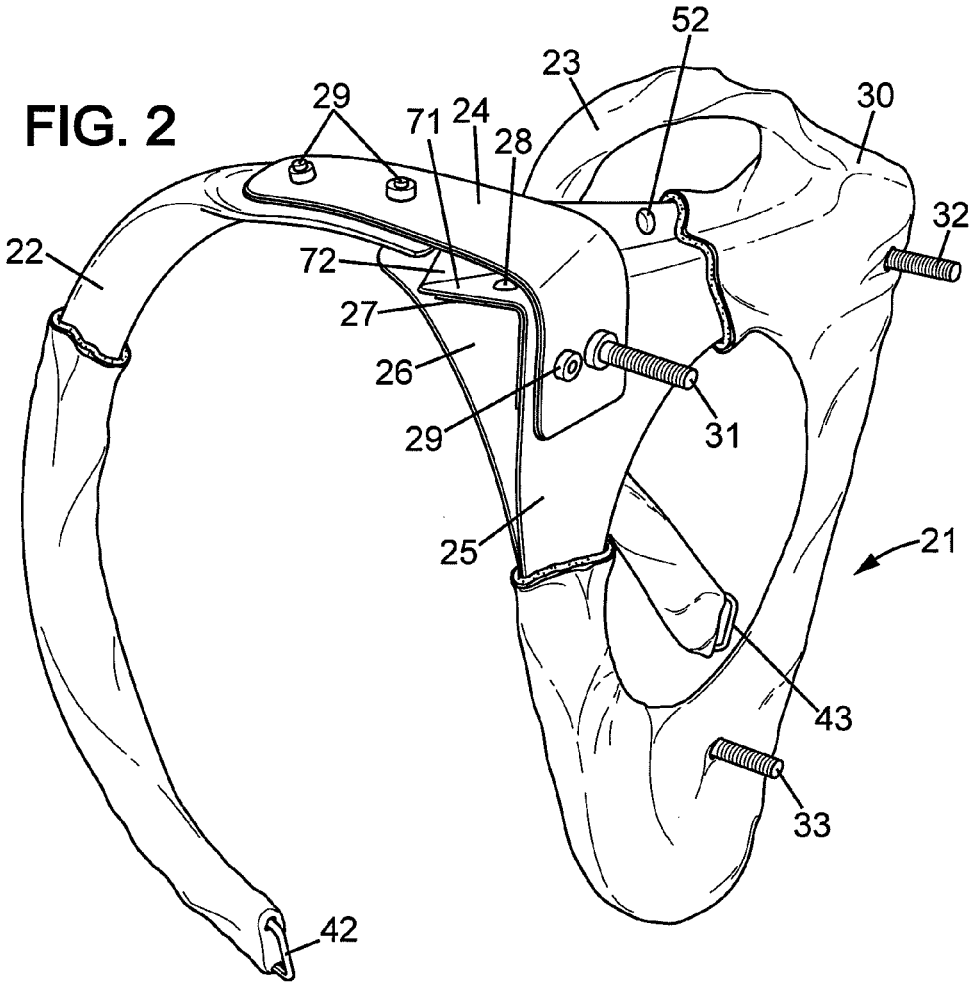
FIG. 2 is a three-dimensional view of a harness according to embodiments of the invention.

As can be seen in FIG. 2, a harness according to some embodiments of the invention is composed of a frame covered with a covering 30. This covering comprises a layer of foam, cotton wadding, carded cotton, or a similar material, which in turn is covered by a decorative covering such as a silky fabric, generally of an iridescent color. This composition of the covering is an example only, as any other composition can be preferred according to the requirements of the application. More complex coverings can also be used, for example to cover separate parts of the frame with different materials, of different textures, colors, etc.

The frame itself essentially comprises a rigid backrest 21, coupled to two rigid branches, forming the shoulder supports 22 and 23, by means of an elastic connecting element for each of them. In FIG. 2, only the elastic connecting element 24 associated with the left shoulder support 22 is visible, the one associated with the right shoulder support 23 being represented with its covering 30.

The backrest 21 and the shoulder supports 22 and 23 are said to be rigid in the sense that, under the normal utilization conditions anticipated for the intended application, they have no elastic or other deformation capacity, whether flexural, torsional, or other. This does not mean that these constituent elements cannot be deformed, or even broken, if they are subjected to stresses exceeding a certain limit, but it means that this limit lies well beyond the forces likely to be applied to them under the normal conditions of using the harness.

Other features of the harness and/or its frame, illustrated in FIG. 2, will now be described. First, the use of the harness will be discussed with reference to the drawings in FIGS. 3 and 4.

Figure 3:
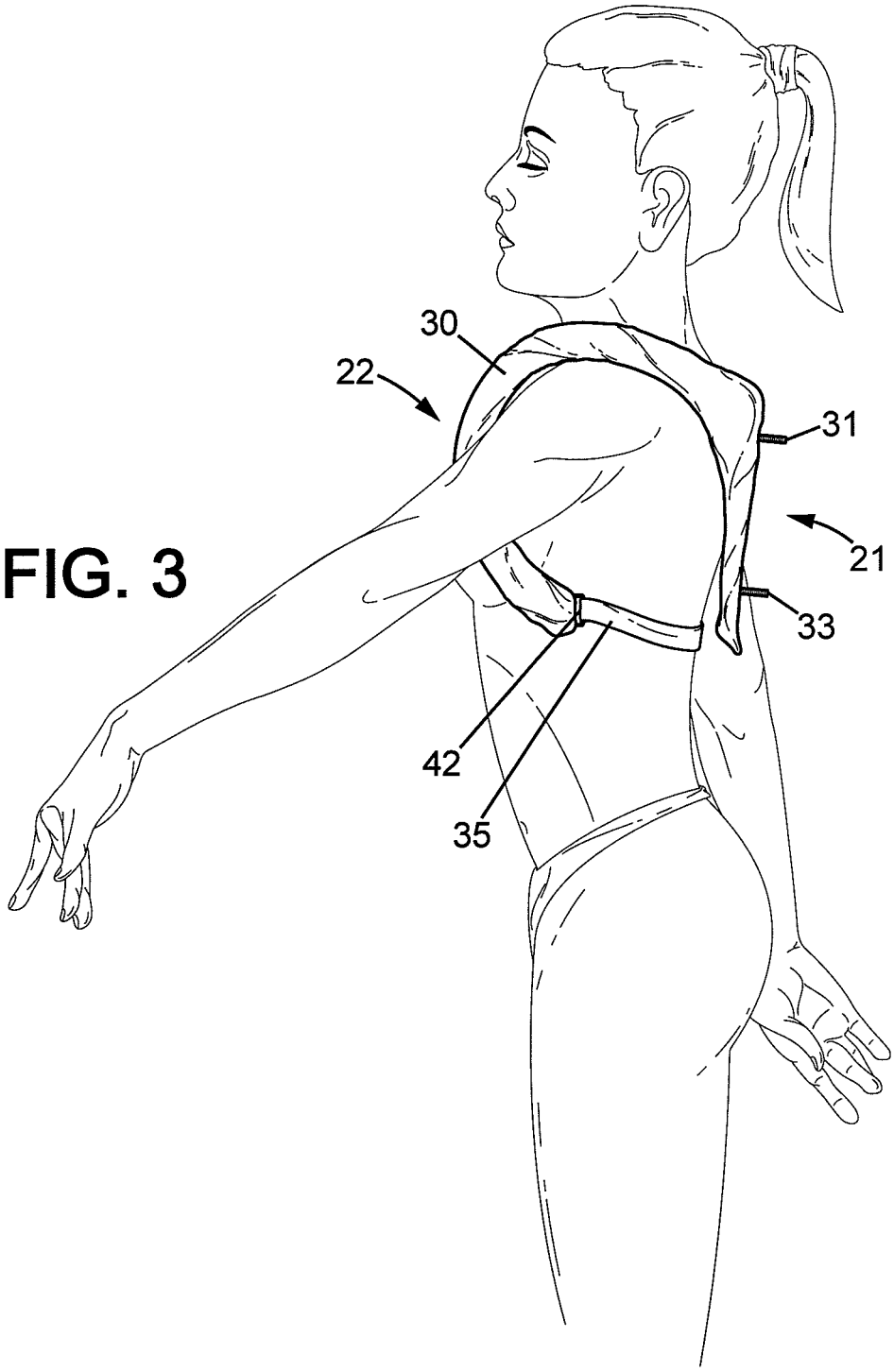
FIG. 3 is a representation of a complete harness worn by a stage performer.

In FIG. 3, the harness is represented in its normal configuration, when it is in place and maintained on the shoulders of a user, for example a cabaret dancer.

In the following description, the orientation, shapes, and more generally the arrangement of the constituent elements of the harness and particularly its frame, are described with reference to the position of the harness on the artist's shoulders in the static standing position, as represented in FIG. 3. As a result, terms such as "in front", "behind", "front", "rear", "towards the front", "towards the back", "above", "below", "upwards", "downwards", "upper", "lower", "left", "right", "towards the left", "towards the right", "horizontal", "vertical", "horizontally", "vertically", etc. are used with reference to this convention.

The backrest 21 is flat against the back of the user, preferably in the upper part of the back to avoid interfering with the movements of the artist's pelvis and legs. The backrest is maintained in this position flat against the back of the dancer by the action of the branches forming the shoulder supports, such as the shoulder support 22. In fact, this shoulder support curves towards the back in a manner that passes under the armpits of the dancer. Each shoulder support ends in a hook that is denoted 42 for the visible shoulder support 22 in FIG. 2 and FIG. 3, and is denoted 43 for the shoulder support 23 which is only visible in FIG. 2. A strap or belt 35 can pass across the dancer's back to connect the hooks 42 and 43 to each other, and/or to the backrest 21, in order to stabilize the position of the harness in spite of the dancer's movements, without injury to her or interfering with her movements. The strap 35 may or may not be made of an elastic material. It can for example be a leather belt, a cotton band, an elastic band, or something similar. These examples are in no way limiting.

Figure 4:
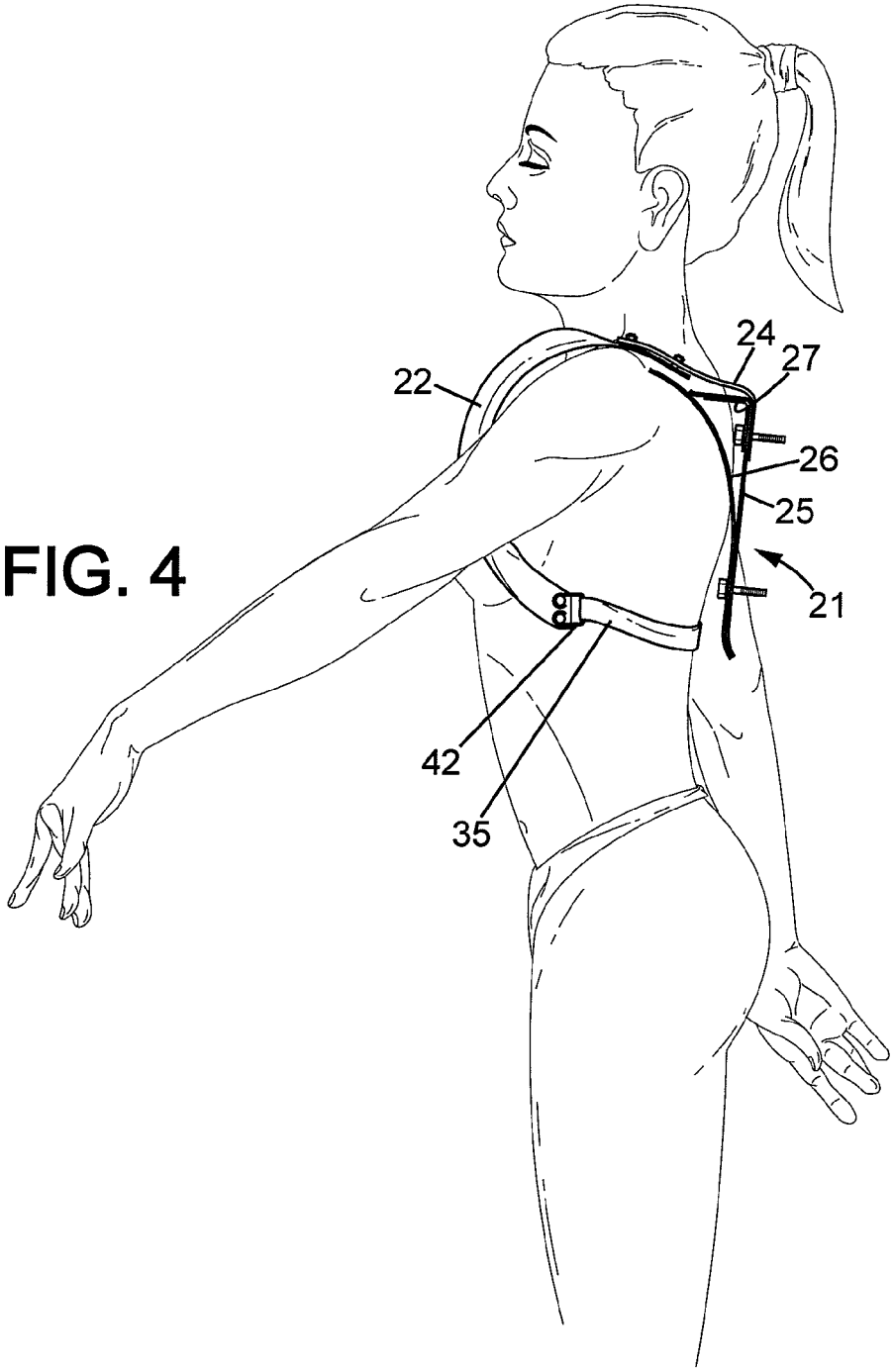
FIG. 4 is a view of only the frame of the harness worn by the artist (with no harness covering)

In the view in FIG. 4, which corresponds to FIG. 3, the harness is represented without the covering 30. This view illustrates the positioning of the primary component elements of the harness frame when said harness is in position on the user. As one will have understood, this configuration does not correspond to the true usage, because in practice the harness is not used on stage without the covering 30 over the frame.

Aside from the hooks 42 and 43, the only parts of the frame which project outside the covering 30 are studs extending substantially horizontally towards the rear, from the backrest 21. In one example, the backrest comprises three such studs 31, 32 and 33. In the example illustrated in FIGS. 2 and 3, the stud 31 is placed in the upper part of the backrest, on the left, while the stud 32 is placed in the upper part, on the right, and the stud 33 is placed in the lower part, substantially in the center (on a horizontal axis running from the left to the right of the dancer). This number and this arrangement of the studs provide good stability when they are used to attach at least one prop to the backrest. For this purpose, the prop can comprise a plate of dimensions dictated by those of the backrest, equipped with holes corresponding to the studs 31, 32 and 33, which allow placing the plate flat against the harness backrest and attaching it, using wing bolts for example. Of course, any variation is possible in the number or position of the studs, depending on the application considered and particularly the number, dimensions, and weight of the props to be supported. It is also understood that more than one prop can be maintained on the backrest 21 by means of such studs.

As is visible in FIGS. 2 and 4, each of the shoulder supports 22 and 23 can be made in tubular form, for example of a tube of aluminum 6060 T6, of a circular cross-section with a diameter equal to 20 millimeters. The tube is forced into the appropriate curve by bending, and flattened at its ends. For example, the bending of each tube can be done using an appropriate guide.

The upper end of the tube, intended to be coupled to the backrest 21 via an elastic element such as the element 24, is flattened into a flat substantially horizontal form. Conversely, the free end of the shoulder support, to which is attached the hook 42 or 43, is flattened into a flat substantially vertical form. Thus, the upper end of the shoulder support can lie flat on the shoulder of the dancer, and its lower end can lie flat against her flank.

In addition, as is visible in FIG. 4, the hook 42 can ideally be attached to the outer side of the lower end of the left shoulder support 22, in a manner that also will not injure the dancer. Symmetrically, the hook 43 of the right shoulder support 23 (visible in FIG. 2) is preferably situated on the outer side of this shoulder support, for the same reasons. The hooks 42 and 43 can be fixed in place by screws or rivets, preferably ensuring that no part passes beyond the inside face of the flat part of the free end of the shoulder support. For example, if a screw is used, it is oriented from the inside to the outside and its head is countersunk. Preferably, the attachment is always made with a rivet, with its inside end, meaning the end closest to the dancer's flank, being bucked or filed off. In both cases, no projecting part of the hook attachment means is then likely to injure the artist when the harness is tightened into position, with the free ends of the shoulder supports lying flat against the flanks.

The same precautions are taken concerning the attachment of the upper end of the shoulder supports 22 and 23 to the elastic element such as the element 24 associated with the left shoulder support 22. Preferably, this attachment is also made by two screws or two rivets 29, visible in FIG. 2.

Because of all the above characteristics, the harness is used under conditions of optimized comfort and ergonomics.

In one embodiment, the backrest 21 essentially comprises three rigid parts, solidly connected to each other in a non-elastic manner. This last expression is understood to mean that the attachment means for these three elements 25, 26 and 27 introduce in the backrest no point of deformation, nor play, nor elasticity, under the normal conditions of using the harness. In other words, these three elements are rigid and rigidly connected to each other. In actuality, having three elements instead of, for example, a single plate, does indeed increase the rigidity of the backrest as a whole.

More particularly, the backrest comprises a rear plate 25 and a front plate 26. Preferably, these two plates press against each other in the lower part of the backrest, while they are spaced apart from each other in the upper part. In this upper part, an angle bracket 27 is arranged between the two plates 25 and 26, acting as a brace between these two plates and contributing to improving the rigidity of the whole.

These three elements 25, 26 and 27 of the backrest will now be described in detail, respectively referring to the diagrams in FIGS. 5, 6 and 7, and 8 and 9.

It should first be noted that the two plates 25 and 26 and the angle bracket 27 can be realized of an aluminum clad sheet for example, of the material known as AU4GA5 (2024). This is a sheet with a 5 micrometer cladding, which has the advantage of being a clean material. Aluminum 4G is a material that has been subjected to hardening treatment so as to be particularly strong, even when very thin. For example, plates 12 millimeters thick are used, which gives the frame a very reasonable weight, less than that of the prior art steel frames described in the introduction. This also allows folding the sheet, as will now be described for each of the plates 25 and 26, and the angle bracket 27.

Figure 5:
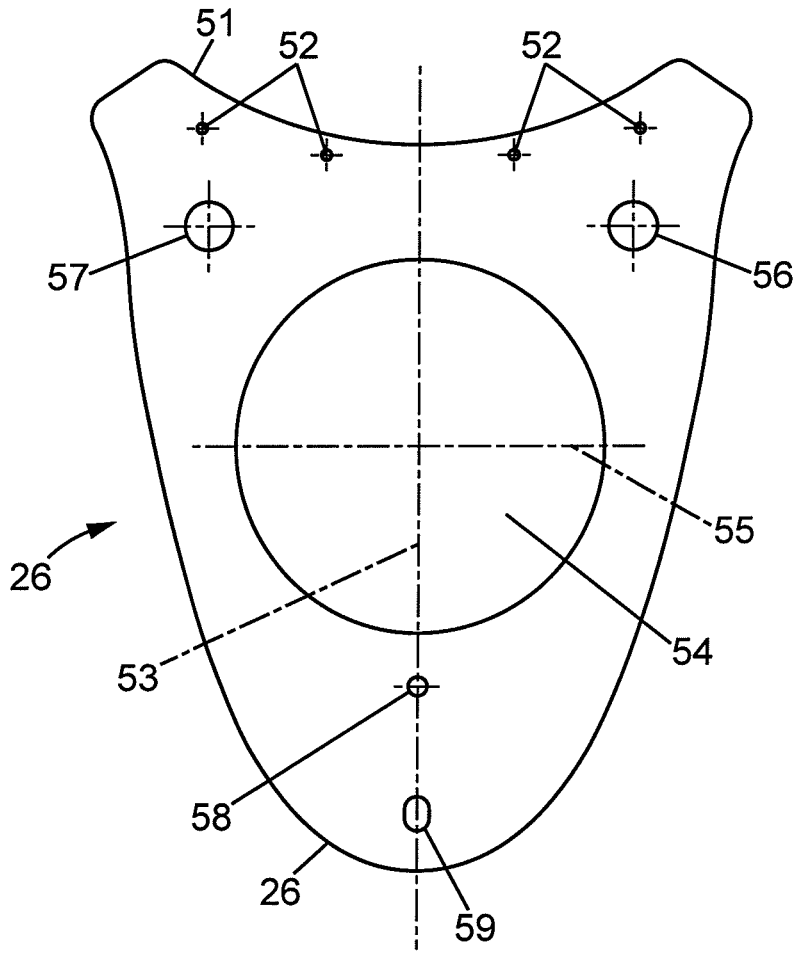
FIG. 5 is a plane view of the front plate of the backrest.

FIG. 5 represents a plane view of the front plate 26. This plate has a general heart shape, with the point at the bottom and the two left and right lobes at the top. The upper edge 51 of the plate 26, between these lobes, is concave in shape with a certain curvature which will be revisited later. Pierced all along the edge 51 and following the same curvature are holes 52, which for example have a diameter equal to 4 millimeters. For example, there are four holes 52 substantially evenly distributed on each side of a vertical axis 53 of the plate. The plate 26 is preferably symmetrical relative to this vertical axis 53. There is an opening 54, for example of a diameter equal to 120 millimeters, in the center of the plate, in order to decrease the weight of the frame and the surface resting against the artist's back. This opening is made by piercing the plate 26 with a circular hole whose center corresponds to the intersection between the vertical axis 53 and a horizontal axis 55.

Holes 56 and 57 are pierced in the area corresponding to the base of the upper left and right lobes of the plate. The respective centers of these holes are aligned along a same horizontal line. Vertically, this line is substantially situated between the lowest point of the curvature of the upper edge 51, and the highest point of the opening 54. The holes 56 and 57 have, for example, a diameter equal to 15 millimeters.

Another hole 58 is pierced on the vertical axis of symmetry 53, substantially at an equal distance (on this vertical axis) from the horizontal axis 55 as are the holes 56 and 57, therefore between the lowest point of the opening 54 and the lower end of the plate 26. Its diameter is for example equal to 6 millimeters.

Another hole 59 is pierced between the hole 58 and the lower end of the plate 26. This is an oblong hole for which the larger dimension (extending vertically) is equal to about 10 millimeters, and the width (horizontally) is equal to about 8 millimeters, in one example. This hole can serve as the passage for a retaining band such as the band 35 visible in FIG. 3.

As can be seen in FIG. 2, the front plate 26 bends slightly forward, from an axis substantially corresponding to the horizontal axis 55 of FIG. 5. This is intended to allow the plate 26 to follow the rounded shape of the artist's back at the base of the neck. The bend is typically limited to a maximum of about 30° from the vertical.

Preferably, the lower end of the plate bends slightly rearwards, from a horizontal axis passing substantially through the center of the hole 59. This bend is intended to prevent the end of the plate 26 from injuring the artist by rubbing against her spine.

Figure 6:
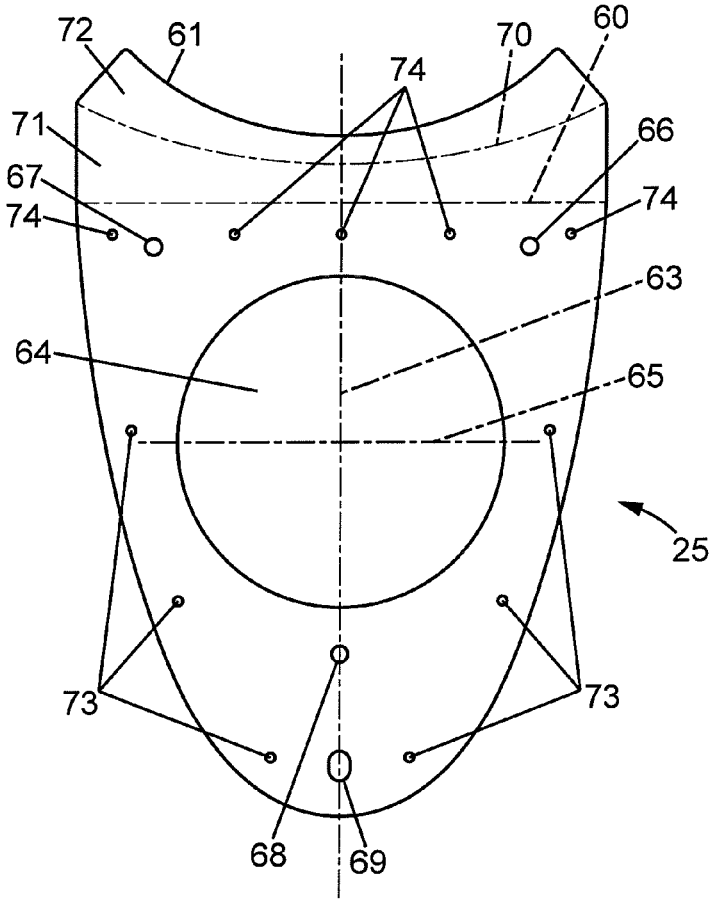
FIG. 6 is a plane view of the rear plate of the backrest.
Figure 7:
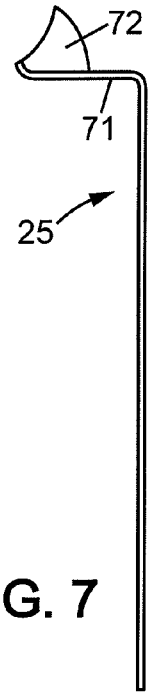
FIG. 7 is a side view of the rear plate of the backrest after folding.

The rear plate 25 will now be described with reference to the diagrams in FIGS. 6 and 7. In FIG. 6, this plate is represented in a plane view. In FIG. 7, it is represented from a left side view, after its upper part has been folded twice, which will be described in more detail below.

This plate 25 also is generally heart-shaped, with dimensions and a shape generally corresponding to that of the plate 26 in FIG. 5, and are even identical in the lower part.

In particular, the plate 25 is also upwardly concave at its upper edge 61. It also comprises a circular opening 64, of the same radius as the opening 54 in the plate 26, its center corresponding to the intersection of a vertical axis of symmetry 63 and a horizontal axis 65.

In the lower part, the plate 25 comprises holes 68 and 69, respectively corresponding in their position and dimensions to the holes 58 and 59 of the plate 26 in FIG. 5. In the upper part, the plate 25 comprises two holes 66 and 67, positioned similarly to the holes 56 and 57 of the plate 26 so as to be concentric to those holes when the plates are superimposed, but with a smaller diameter, for example of 6 millimeters like the hole 68. As will have been understood, the holes 66, 67 and 68 are intended for attaching long screws whose threaded shanks, which extend beyond the plate towards the back, correspond to the respective studs 32, 31 and 33 (FIG. 2). As will be explained below concerning the diagram in FIG. 10, the holes 56 and 57 in the front plate 26 are intended for inserting these screws or bolts and/or tightening them with a screwdriver or wrench, once the two plates 25 and 26 and the bracket 27 are assembled.

Lastly, holes 73 are uniformly distributed along the left and right edges of the plate 25 between the level of the horizontal axis 65 and the bottom of the plate 25, for example three holes on the left side and three holes on the right side of the plate. Other holes 74, for example five in number, are pierced along a horizontal line which is vertically positioned slightly above the line passing through the centers of the holes 66 and 67. These are for example holes with a diameter of 4 millimeters. The holes 73 and 74, like the holes 52 of the other plate 26, are intended for attaching the front plate 26 to the rear plate 25, preferably by rivets.

In its upper region, the rear plate 25 comprises two parts 71 and 72 which are folded relative to the general plane of the sheet from which the plate 25 is made. The folded parts 71 and 72 are also visible in FIG. 2 and in FIG. 7.

More particularly, the part 71 is folded horizontally on a first fold axis 60, which is a horizontal axis situated above the horizontal line passing through the centers of the holes 66 and 67. After this fold, the lower part of the plate 25 and its folded part 71 form an angle slightly less than 90°. The part 72 is then folded again, upwards from a second fold axis 71 which is a generally horizontal axis but extends along a curved line which is upwardly concave.

The horizontal fold axis 60 is vertically located substantially at an equal distance from the lowest point of the curvature of the upper edge 61 of the plate 26, and the highest point of the opening 64.

The intersection between the fold axis 70 and the vertical axis of symmetry 63 is approximately centered between the intersection between the folding axis 60 and the vertical axis 63, and the lowest point of the curvature of the upper edge 61 of the plate 25.

After folding, the part 72 forms an angle of at most about 30° from the vertical, which substantially corresponds to the angle that the bent upper part of the plate 26 forms with the vertical.

Figure 8:
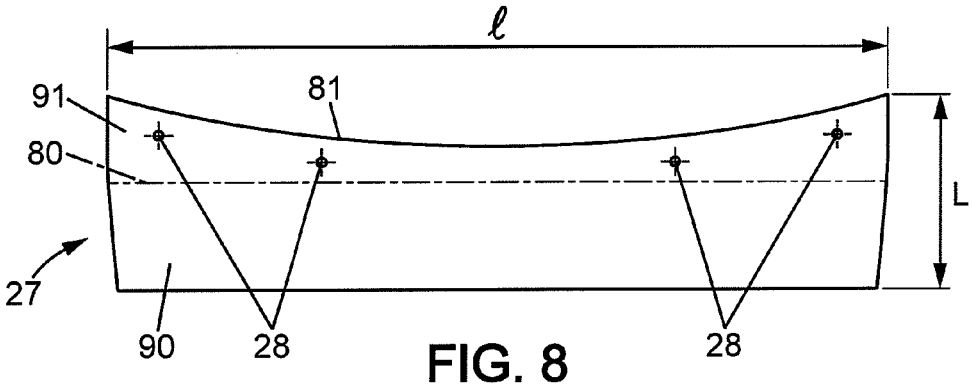
FIG. 8 is a plane view of the angle bracket of the backrest.
Figure 9:
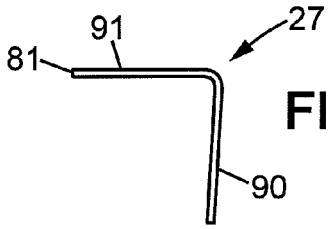
FIG. 9 is a side view of the angle bracket after folding.

Now referring to FIG. 8 and FIG. 9, the angle bracket 27 is obtained from a flat aluminum sheet cut out and pierced as shown in FIG. 8 (which is a plane view), and folded to obtain the angle bracket shown in FIG. 9 (which is a left side view).

As is shown in FIG. 8, the upper edge 81 of the sheet, i.e. of the angle bracket before folding, has an upwardly concave curvature, with an opening slightly larger than that of the curvature of the respective upper edges 51 and 61 of the front plate 26 and the rear plate 25.

The width l (horizontal dimension) of the aluminum plate of which the angle bracket is made, substantially corresponds to that of the upper part of the plates 25 and 26. The fold axis 80 is a horizontal axis which is vertically situated at substantially half of the height L (vertical dimension) of the plate, considered at its left and right lateral edges.

Holes 28 are made along a curved line between the fold axis 80 and the upper edge 81, having substantially the same curve as the edge 81. There can be, for example, two such holes 28 on the left side and, symmetrically, two holes 28 on the right side. The diameter of these holes is for example equal to 4 millimeters. These serve to attach the angle bracket to the rear plate 25, by means of rivets.

As can be seen in FIG. 9, the upper part 91 of the plate (the part that has the holes 28 and the edge 81), is horizontally folded along the axis 80 in a manner that, after folding, forms an angle with the lower part 90 of slightly more than 90°, the lower part 90 being the one opposite the edge 81 and being arranged vertically in the assembled frame configuration.

Figure 10:
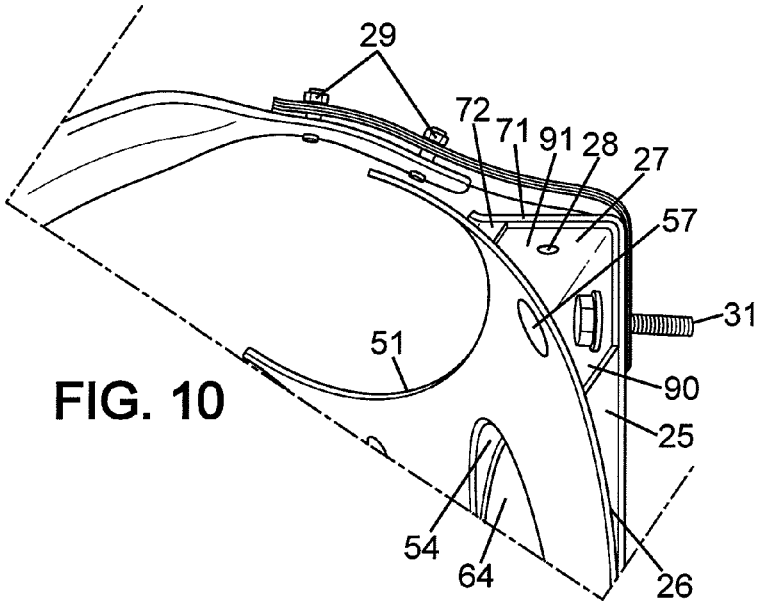
FIG. 10 is a partial view of the frame, showing the detail of the elastic coupling elements attaching the backrest to the shoulder supports.

As can be seen in FIG. 2, and also in FIG. 10 which shows the details, the elastic coupling elements between the backrest 21 and the shoulder supports 22 and 23, comprises for example a leaf spring. Such a spring comprises stacked metal plates, for example of stainless steel, and preferably of the same dimensions so that there is only one reference.

A leaf spring has a high damping coefficient for travels, i.e. very low amplitudes of deformation. In addition, the essentially flat shape thereof is compatible with its mode of attachment as above, and with the covering over the frame.

The frame is assembled from the bent front plate 26, the twice-folded rear plate 25, and the angle bracket formed by folding the plate in FIG. 8, as follows.

First, the angle bracket is positioned inside the angle formed by the 90° folding of the horizontal part 71 of the rear plate 25. Four holes 4 millimeters in diameter are pierced in said rear plate, using the holes 28 of the upper part 91 of the angle bracket as a piercing guide so that there is no misalignment between the holes 28 on the angle bracket and the corresponding ones on the plate 25. Then the horizontal/upper part 91 of the angle bracket 27 and the horizontal part 71 of the rear plate 25 are attached to each other, for example with four rivets through the aforementioned holes.

Second, and in the same manner, five holes are pierced in the vertical/lower part 90 of the angle bracket, 4 millimeters in diameter, using the five holes 74 of the vertical/lower part of the plate 25 as a guide, and then the angle bracket 27 and the rear plate 25 are attached to each other, for example with three rivets through three of these holes, meaning the holes located in the center. The leftmost and rightmost holes serve for respectively attaching the left elastic element 24 and the right elastic connecting element to the backrest, by which the backrest is respectively coupled to the shoulder supports 22 and 23. This attachment can be done using bolts, the left one being visible in FIG. 2 and denoted 29.

Positioned and attached in this manner, the angle bracket 27 assures the stability of the fold angles of the rear plate 25.

Third, the vertical/lower part 90 of the angle bracket is pierced, 6 millimeters in diameter, using the two holes 66 and 67 of the vertical/lower part of the plate 25 as a guide. A screw that has its distal end (opposite the head) pointing towards the back, is passed through these holes and tightened with a nut and a tooth washer. The threaded shanks of these screws, of a length for example of 30 millimeters, respectively form the studs 31 and 32 serving to attach the prop using wing nuts for example. Advantageously, this bolt (screw and nut) also serves for attaching to the backrest the corresponding elastic coupling element, such as the element 24 for the left side, to supplement the bolt attachment mentioned in the above paragraph.

Fourth, a first end of the elastic coupling elements between the backrest and the shoulder supports, such as the spring 24 for the left side, is attached. For this purpose, two holes 4 and 6 millimeters in diameter are pierced in the stack of flat leaves (each obtained by cutting out and/or machining a plate). The resulting holes are intended for attaching the stack to the vertical part of the rear plate 25 of the backrest, by the bolts 29 and the screws 31 and 32, as has been described in the two previous paragraphs.

Fifth, the front plate 26 is pierced through the holes 73 of the rear plate 25, using them as a guide, and the lower parts of the two plates are directly attached to each other through these holes, for example with the use of rivets. Of course, the openings 54 and 64 are then concentric. This attachment is completed using a bolt of which the screw portion passes through the concentric holes 58 and 68 respectively provided on the plates 26 and 25. The threaded shank of the screw then corresponds to the stud 33 (FIG. 2).

Sixth, the stack of leaves constituting the elastic coupling element, such as the element 24 for the left side of the harness, is bent forwards. In light of the fact that this is a stack of metal leaves, it is not truly folded, but bent, in the sense that the local radius of curvature of the leaves is relatively high compared to what can be obtained when folding a single leaf. In other words, the fact that the three leaves are bent simultaneously implies that there is a greater angle of curvature than the one obtained by bending a single leaf. Even so, after bending, the two ends of the stack are in respective planes which form an angle substantially equal to 90°. On the side already attached to the backrest, the end is vertical. On the other side, the end is substantially horizontal. In this latter side, the stack of leaves is pierced with two holes, by which the corresponding shoulder support is attached (for example the shoulder support 22 for the left side of the harness), for example with other rivets 29 as can be seen in FIG. 2.

At that point, any force exerted on the shoulder support 22 tending to move it away from its static position relative to the backrest 21, or conversely, gives rise to an opposing force which results from the resistance of the metal leaves of the elastic element 24. This is the damping effect of the leaf spring. Thus the harness, although it has a rigid structure at the shoulder supports and backrest, provides an elastic coupling between the former and the latter. This coupling attenuates, particularly at the point of contact between the shoulder supports and the top of the artist's shoulder, the forces exerted by the pitching and/or lurching motions of the prop or props supported by the harness.

One will note that the end of the elastic coupling element 24 attached to the shoulder support 22 is preferably placed above said support. The shoulder support is made from the flattened part of the tube, which rests against the top of the artist's shoulder. The contact is therefore complete and stable, due to the rigidity of the shoulder support, and is therefore unlikely to injure the artist.

To conclude, one will note that all the rivets used are for example of the type with a round head, such as those used in aviation. The rivet heads which project above from the surfaces intended to come into contact with the artist's body are preferably filed off or bucked, to avoid any risk of injury or of damage to the harness covering 30.

What is claimed is:

1. A frame for a harness for the wearing of at least one stage prop by a stage performer, comprising:

a backrest suitable for supporting the stage prop and for resting against the back of the artist; and elements forming shoulder supports, suitable for positioning and/or maintaining the harness in place on the artist's shoulders, wherein:

the backrest as well as the elements forming the shoulder supports are rigid;

the elements forming the shoulder supports are coupled to the backrest by elastic coupling elements;

the backrest comprises a rigid front plate and rear plate, substantially vertical and parallel to each other while being maintained rigidly apart from each other for at least a part of their facing surfaces; and the rear plate comprises, in its upper part, a first part folded horizontally towards the front plate, and extended by a second part folded vertically upwards, which rests against the front plate and is fixed to said front plate.

2. A frame according to claim 1, wherein an upper end of the front plate is bent forwards.

3. A frame according to claim 1, wherein the backrest comprises a central opening.

4. A frame according to claim 1, wherein the shoulder supports are in the form of a circular tube, horizontally flattened at the upper end of the tube and vertically flattened at the lower end of the tube.

5. A frame according to claim 1, wherein the elastic coupling elements each comprise at least one leaf spring.

6. A frame according to claim 1, comprising an angle bracket arranged between the front plate and the rear plate in a manner that keeps them spaced apart from each other.

7. A frame according to claim 6, wherein the angle bracket comprises a horizontal part fixed to the horizontal part of the rear plate, and a vertical part fixed to the rear plate, behind said horizontal part of the rear plate.

8. A harness for the wearing of at least one stage prop by a stage performer, comprising:

a frame, wherein the frame comprises:

a backrest suitable for supporting the stage prop and for resting against the back of the artist; and elements forming shoulder supports, suitable for positioning and/or maintaining the harness in place on the artist's shoulders, wherein:

the backrest as well as the elements forming the shoulder supports are rigid;

the elements forming the shoulder supports are coupled to the backrest by elastic coupling elements;

the backrest comprises a rigid front plate and rear plate, substantially vertical and parallel to each other while being maintained rigidly apart from each other for at least a part of their facing surfaces; and the rear plate comprises, in its upper part, a first part folded horizontally towards the front plate, and extended by a second part folded vertically upwards, which rests against the front plate and is fixed to said front plate.

9. A frame for a harness for the wearing of at least one stage prop by a stage performer, comprising:

a backrest including means for supporting the stage prop, the backrest comprising:

a first rigid plate, the first rigid plate being substantially flat;

a second rigid plate, the second rigid plate having a lower portion which is substantially flat and an upper portion which is curved; and means for attaching the second rigid plate to the first rigid plate at the lower portion of the second rigid plate;

wherein the curved upper portion of the second rigid plate is configured for resting against a curved back and shoulder area of the stage performer;

a pair of curved rigid elements, each curved element having a first end and a second end; and a pair of elastic coupling elements, each elastic coupling element coupling the first end of a curved rigid element to the first rigid plate of the backrest.

10. The frame of claim 9, wherein the pair of elastic coupling elements each comprise at least one leaf spring.

11. The frame of claim 9, wherein the pair of elastic coupling elements are connected to an outer surface of the first rigid plate and an inner surface of the first rigid plate is attached to the second rigid plate at the lower portion of the second rigid plate.

12. The frame of claim 9, where the second ends of each curved rigid element include an attachment means, the frame further comprising a means for interconnecting the second ends of the curved rigid elements by passing behind the back of the stage performer.

13. The frame of claim 9, wherein the curved rigid elements are in the form of a circular tube, horizontally flattened at the first end and vertically flattened at the second end.

14. The frame of claim 9, wherein the second rigid plate is not attached to the first rigid plate at the curved upper portion of the second rigid plate, the frame further comprising means for maintaining the unattached curved upper portion of the second rigid plate spaced apart from the first rigid plate apart.

15. The frame of claim 14, wherein the means for maintaining biases against an outer surface of the curved upper portion of the second rigid plate at the curved back and shoulder area of the stage performer.

* * * * *